US006261132B1

(12) United States Patent
Koseki et al.

(10) Patent No.: US 6,261,132 B1
(45) Date of Patent: Jul. 17, 2001

(54) HEADER CONNECTOR FOR FUTURE BUS

(75) Inventors: Yoshitsugu Koseki, Nagano (JP); Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/751,487

(22) Filed: Dec. 29, 2000

(51) Int. Cl.[7] ..... H01R 13/40
(52) U.S. Cl. ..... 439/733.1
(58) Field of Search ..... 439/733.1, 752.5, 439/78, 678

(56) References Cited

U.S. PATENT DOCUMENTS 3,621,444 * 11/1971 Stein ..... 439/733.1
5,516,301 * 5/1996 Kawakita ..... 439/733.1
5,910,031 * 6/1999 Goto ..... 439/752.5
5,980,271 * 11/1999 MacDougall et al. ..... 439/733.1
6,165,027 * 12/2000 Huang et al. ..... 439/733.1

* cited by examiner

*Primary Examiner*—Tho D. Ta
(74) *Attorney, Agent, or Firm*—Wei Te Chung

(57) ABSTRACT

A header connector (10) of a future bus includes an insulative housing (12) having a bottom wall (14) defining a plurality of receiving holes (20) therethrough for receiving a corresponding plurality of pins (22) therein. Each pin includes a contact portion (24), a retaining portion (25), and a plurality of tail portions (30). Each pin has a retention mechanism (26) formed thereon, for securing the pin in the corresponding receiving hole. Each receiving hole has opposite end portions, and an intermediate portion wider than the end portions. A width and a length of the intermediate portion are greater than a thickness and a width of the contact portion of each pin respectively, so that the contact portion can freely pass through the receiving hole during assembly. A width of the end portions is less than a thickness of the retention mechanism, for firm engagement therewith.

8 Claims, 3 Drawing Sheets

HEADER CONNECTOR FOR FUTURE BUS

BACKGROUND OF THE INVENTION

1. Field of the Invention

The present invention relates to a future bus electrical connector, and more particularly to a header connector of a future bus receiving pins such that contact portions of the pins are prevented from being scratched during assembly.

2. Related Art

Communication systems commonly consist of a variety of electrical components which transmit and receive information at high speeds. Electrical connectors which facilitate high frequency signal transmission are thus required to interconnect the components of the system. A future bus electrical connector, which is effective in applications requiring high frequency signal transmission, is commonly used in communication systems for connecting an electrical card to a printed circuit board.

The future bus consists of a header connector electrically connected with and securely mounted on the printed circuit board, and a receptacle connector received in the header and electrically engaged therewith. The card is electrically engaged with the receptacle connector and retained thereto. Thus the card is electrically connected to the printed circuit board by means of the future bus. Such future bus is disclosed in U.S. Pat. No. 4,975,084.

An insulating housing of the header connector has a base defining a plurality of receiving holes therethrough for receiving a corresponding plurality of pins therein. The pins are received in corresponding holes defined in the printed circuit board at one end, and engage with conductive contacts of the receptacle connector at the other end. The pins are retained within the housing by means of a retaining portion formed on each pin, for interferential engagement with inner walls of the corresponding receiving hole. The retaining portion commonly consists of barbs protruding from opposite sides of each pin, whereby an interference area between the barbs and the inner walls of the corresponding receiving hole is established along a longitudinal direction of the housing. However, the interference area is insufficient to securely retain the pins therein. In addition, the force of the barbs acting on the inner walls of each receiving hole results in a deformation of the housing along the longitudinal direction thereof.

U.S. Pat. No. 5,980,271 discloses an improved pin to solve the above-mentioned problem. The pin provides embossments on a face of the retaining portion thereof, so that the embossments exert an interferential force on an inner wall of a rectangular receiving hole of the housing during inserting the pin into the hole. Such interferential force is perpendicular to a longitudinal direction of the housing. In order to obtain a sufficient interference force or a sufficient interference area, the height of the receiving hole is designed to be less than the thickness of the retaining portion, and approximately equal to the thickness of the contact portion of the pin. Thus, the contact portion of the pin unavoidably skids along inner walls of the receiving hole. This results in scratches on the contact portion and diminished signal transmission. Furthermore, the pin and the hole cannot be easily aligned. Handling of the pin assembly is troublesome, and the assembly may even be thereby distorted.

Therefore, it is desired to provide an improved header connector of a future bus to overcome the above disadvantages and problems.

SUMMARY OF THE INVENTION

An object of the present invention is to provide an improved header connector for a future bus having receiving holes with opposite end portions and an intermediate portion wider than the end portions in the insulative housing, the connector receiving corresponding pins such that scratching of contact portions of the pins is prevented.

Another object of the present invention is to provide an improved header connector for a future bus having receiving holes with opposite end portions and an intermediate portion wider than the end portions in the insulative housing, the connector readily receiving corresponding pins such that distortion of the pins is prevented.

A further object of the present invention is to provide an improved header connector for a future bus which is easy to manufacture.

These and other objects are achieved by a header connector of a future bus in accordance with the present invention. The header connector includes an insulative housing having a bottom wall defining a plurality of receiving holes therethrough for receiving a corresponding plurality of pins therein, and two side walls projecting upwardly from two opposite sides of the bottom wall. Each pin includes a contact portion for engaging with a corresponding contact of a receptacle connector of the future bus, a retaining portion having a retention mechanism formed thereon for securing the pin in the corresponding receiving hole, and a plurality of tail portions for reception in corresponding holes defined in a PCB. Each receiving hole has opposite end portions, and an intermediate portion wider than the end portions. A width and a length of the intermediate portion are greater than a thickness and a width of the contact portion of each pin, respectively. Thus the contact portion can freely pass through the receiving hole during assembly. A width of the end portions is less than a thickness of the retention mechanism, for firm engagement therewith.

These and additional objects, features and advantages of the present invention will become apparent after reading the following detailed description of a preferred embodiment of the invention taken in conjunction with the appended drawings.

DETAILED DESCRIPTION OF THE PREFERRED EMBODIMENT

Figure 1:
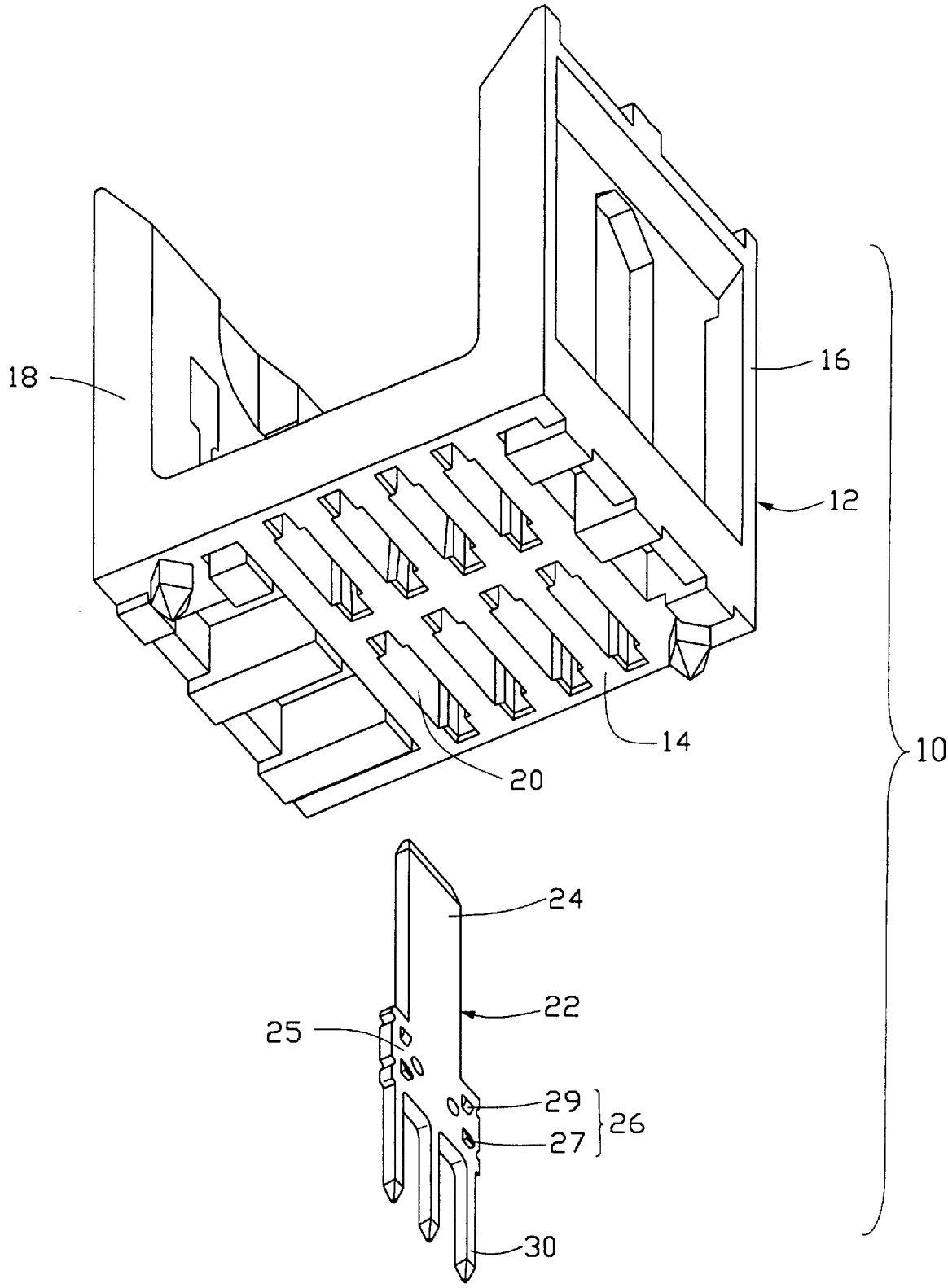
FIG. 1 is an exploded view of a header connector for future bus in accordance with the present invention.

Referring to FIG. 1, a header connector 10 for a future bus of the present invention comprises an insulative housing 12 and a plurality of pins 22. The insulative housing 12 has a bottom wall 14 and first and second side walls 16, 18 projecting upwardly from two opposite sides of the bottom wall 14. The bottom wall 14 defines a corresponding plurality of receiving holes 20 for receiving the pins 22 therein, respectively.

Each pin 22 is formed by conventional stamping operations, and is substantially planar. Each pin 22 includes a contact portion 24 for engaging with a corresponding contact of a receptacle connector of the future bus, a retaining portion 25 which is wider than the contact portion 24, and a plurality of tail portions 30 extending downwardly from the retaining portion 26 for reception in a corresponding hole defined in a PCB (not shown). The retention mechanism 26 is formed on a surface of the retaining portion 25, for interferentially engaging with an inner wall of a corresponding receiving hole 20 of the housing 12. The retention mechanism 26 includes a pair of first projections 27 and a pair of second projections 29. The first projections 27 are ramp-shaped, and are positioned on opposite sides of the surface and adjacent the tail portions 30. The second projections 29 are hump-shaped, and are positioned on opposite sides of the surface and adjacent the contact portion 24. The second projections 29 provide a larger interference area with the inner wall of a corresponding receiving hole 20, and are preferred for applications requiring particularly firm retention of the pins 22 within the housing 12.

The insulative housing 12 has eight receiving holes 20 defined in the bottom wall 14 thereof, and arranged in two rows. Each receiving hole 20 has two opposite end portions and an intermediate portion wider than the end portions.

Figure 2:
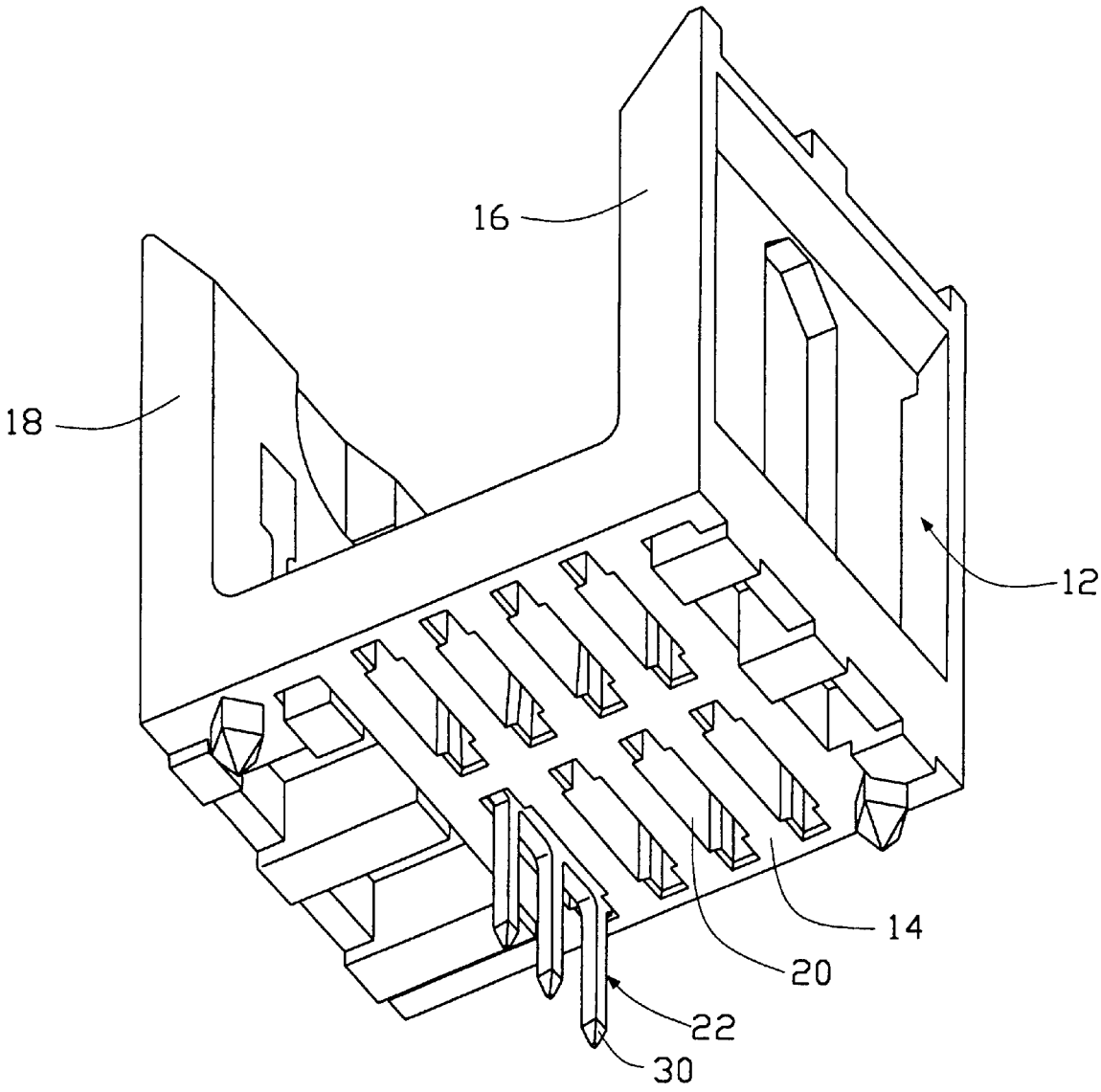
FIG. 2 is an assembled view of FIG. 1.
Figure 3:
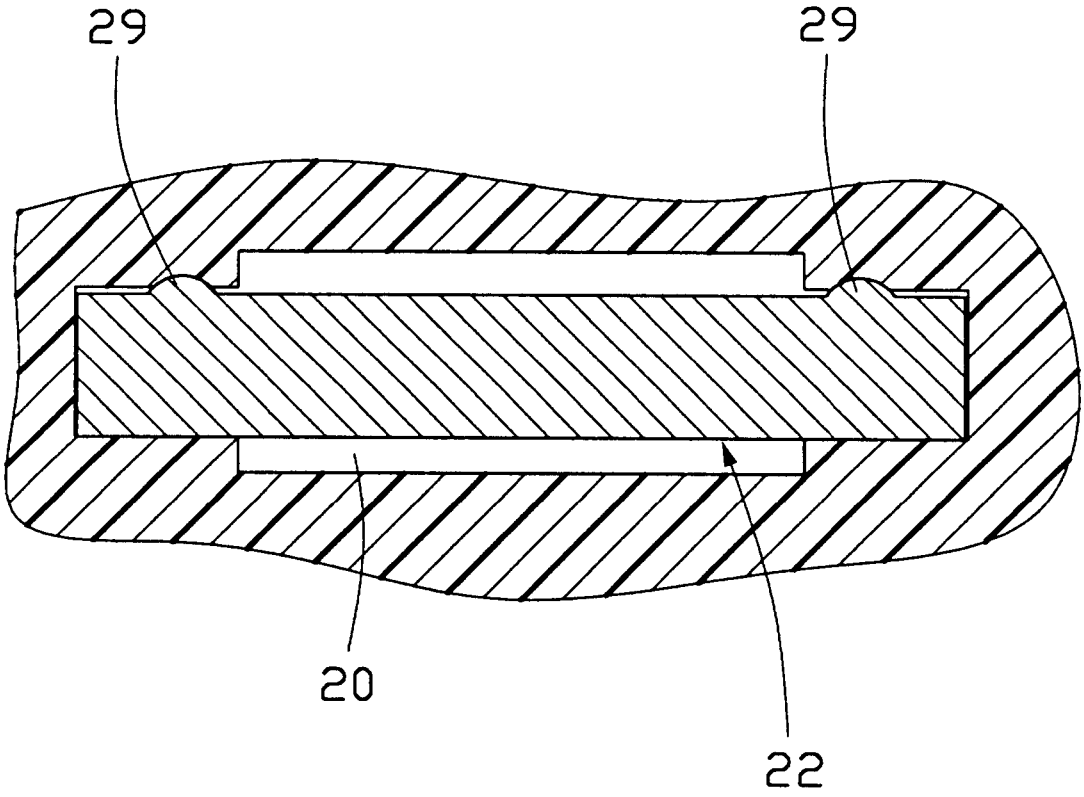
FIG. 3 is a cross-sectional view of a pin of the header connector of FIG. 1 fully inserted into a housing of the header connector.

Referring to FIGS. 2 and 3, a width and a length of the intermediate portion are greater than a thickness and a width of the contact portion 24 of the pin 22, respectively. Therefore, the contact portion 24 will not skid against or interfere with the inner wall of the receiving hole 20 when it is inserted therein. Thus the contact portions 24 are not scratched by the housing 12 during assembly. The width of each end portion is less than the thickness of the retention mechanism 26. After the contact portion 24 is freely passed through the receiving hole 20, the two pairs of first and second projections 27, 29 are aligned with two opposite end portions of the receiving hole 20 respectively. The first and second projections 27, 29 are interferentially engaged with inner walls of the end portions of the receiving hole 20, and the pin 22 is thus retained in the receiving hole 20. The tail portions 30 of the pin 22 remain under the bottom wall 14, for reception into the corresponding holes of the PCB (not shown). From the above description, it can be understood that the electrical contact portions 24 of the pins 22 are not damaged at any time during the whole assembly procedure. In addition, the structures of the pins 22 and the receiving holes 20 also facilitate the assembly.

Specifically, the unique features of the invention are realized by the receiving hole 20 having narrower end portions and a wider intermediate portion, and by the projections 27, 29 of the retention mechanism 26 of the pin 22. All these components are simple and easy to manufacture.

While the present invention has been described with reference to a specific embodiment thereof, the description is illustrative and is not to be construed as limiting the invention. Various modifications to the present invention may be made to the preferred embodiment by those skilled in the art without departing from the true spirit and scope of the invention as defined by the appended claims.

We claim:

1. A header connector comprising:

an insulative housing having a bottom wall, and a first side wall and a second side wall projecting upwardly from two opposite sides of the bottom wall respectively, the bottom wall having a plurality of receiving holes defined therethrough, each receiving hole having two opposite end portions aligned in a first direction and an intermediate portion, a width and a length of said intermediate portion are greater than a width and a length of each end portion; and a plurality of planar pins each having a contact portion, a tail portion and a retaining portion, the contact portion passing through the intermediate portion of the receiving hole without making contact therewith, the tail portion extending downwardly from the retaining portion for reception in a corresponding hole in a printed circuit board, the retaining portion having a retention mechanism formed on a planar surface thereof and projected in a second direction perpendicular to said first direction for interferentially engaging with inner walls of the end portions of the receiving hole.

2. The header connector as claimed in claim 1, wherein each retaining portion is wider than the corresponding contact portion.

3. The header connector as claimed in claim 1, wherein said tail portion comprises a plurality of tail portions.

4. The header connector as claimed in claim 1, wherein the retention mechanism comprises a plurality of first projections and a plurality of second projections.

5. The header connector as claimed in claim 4, wherein each first projection is ramp-shaped.

6. The header connector as claimed in claim 4, wherein the first projections are positioned on opposite sides of the surface of the retaining portion and adjacent the tail portions.

7. The header connector as claimed in claim 4, wherein each second projection is hump-shaped.

8. The header connector as claimed in claim 4, wherein the second projections are positioned on opposite sides of the surface of the retaining portion and adjacent the contact portion.

* * * * *